United States Patent [19]

Bichet

[11] 4,422,198

[45] Dec. 27, 1983

[54] MACHINES FOR BENDING FOOTWEAR COUNTERS

[75] Inventor: Lucien Bichet, Draveil, France

[73] Assignee: Anver, Maisons Alfort, France

[21] Appl. No.: 367,353

[22] Filed: Apr. 12, 1982

[30] Foreign Application Priority Data

May 5, 1981 [FR] France ..... 81 08843

[51] Int. Cl.[3] ..... A43D 11/00

[52] U.S. Cl. ..... 12/54.3; 12/53.5

[58] Field of Search ..... 12/1 R, 1 W, 1 A, 53.5, 12/54.2, 54.3

[56] References Cited

U.S. PATENT DOCUMENTS 3,039,288 6/1962 Torre et al. ..... 12/54.3

3,138,810 6/1964 Becker ..... 12/54.3

3,325,840 6/1967 Barton et al. ..... 12/54.3

*Primary Examiner*—Patrick D. Lawson

*Attorney, Agent, or Firm*—Browdy and Neimark

[57] ABSTRACT

A machine for making very long counters shaped in a single pass, comprising a first double shaper/punch station for performing hot reactivation of the counter and a second shaper/punch station for effecting bending and stabilization of the back elements of the footwear. The machine includes very long punches, bent to the exact shape of the counter and at the second station, comprises shapers the last edge of which exhibits a hardness notably greater than that of the upper part of the shaper. The machine is particularly adapted for making women's high heel shoes.

3 Claims, 2 Drawing Figures

MACHINES FOR BENDING FOOTWEAR COUNTERS

FIELD OF THE INVENTION

This invention relates to apparatus for making footwear and more particularly to a particular double-station machine for making very long counters. The machine operates on pairs of footwear, and is adapted to thermally reactivate a glue material, which has been applied to parts of footwear elements which are to be assembled. The machine also provides a final shape to the back part of the footwear.

BACKGROUND OF THE INVENTION

In well known machines designed to shape the back part of footwear, bending has been effected using as shaper by introducing the back of the footwear on a metal last (or punch) and then putting the last in contact with the curved element or the shaper under conditions of pressure. Quite often, the machine works on pairs of footwear and generally comprises on the same frame and in the upper part of the machine, two stations for the hot reactivation of a glue for assembly of the constitutive elements of the footwear. In the lower part of the machine, the double shaper/punch station is adapted to perform the bending and stabilizing operation at a low temperature.

These prior art machines are particularly suitable for making current footwear in which the back parts do not exhibit a very long bend, as for example, footwear for men. However, when shoes with long counters are involved as, for example, women's high-heel shoes, this known apparatus can work only on the back part of the counter and does not assure the correct shape of the bend that extends over this latter counter. To obtain this long bend, it is necessary to utilize either prebent counters obtained by preliminary fabrication or to use so-called "chemical" counters, i.e. those which are soaked in a solvent to soften them and are then worked on a wood punch to provide them with the necessary shape.

OBJECTS AND SUMMARY OF THE INVENTION

These operations are long and bothersome and the object of the invention relates to eliminating them by using a machine, adapted in a single operation on the machine to bend directly the very long counters which are cut flat from sheets of thermogluable material and inserted in the upper.

The new machine therefore, comprises a double station located in the upper part thereof for reactivation of the thermal glue, which has been applied to the preassembled elements of the footwear. In the lower part of the machine, a second double shaper/punch station is located, which is adapted to perform the bending operation described above. According to the essential characteristics of the invention, the metal punch used at each of the second two stations is bent over a great length for effectively shaping the counter. Moreover, located at the shaper the second station is made so that its lower part, which according to usage will be called the "last edge", possesses a hardness which is clearly greater than that of the upper part.

BRIEF DESCRIPTION OF THE DRAWINGS

The invention will be better understood by a more detailed description of a nonlimiting embodiment illustrated by the accompanying diagrammatic drawings which represent.

DETAILED DESCRIPTION OF PREFERRED EMBODIMENTS

Figure 1:
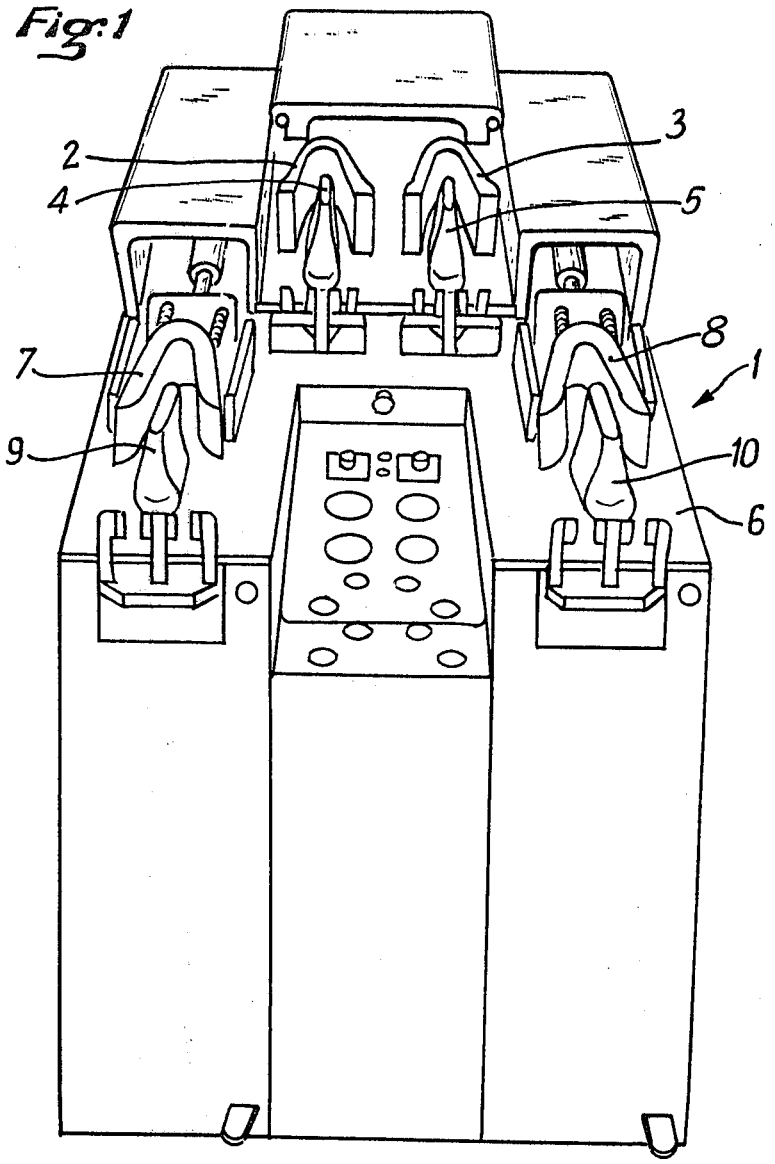
FIG. 1: a type of machine according to the invention.

As shown in FIG. 1, the counter bending machine is a known type of automatic operation device and it will be noted that it is essentially provided on the upper part of frame 1 with a set of two shapers (2,3) having metal punches (4,5) and is further provided, on the work table 6, with a double station comprising two shapers (7,8) with their respective punches (9,10). The double upper station is intended for the hot reactivation of counters made of thermofusible and thermogluable material. The shaper may be made of a two layered material of which, one constitutes a silicone resin base charged with 30/40% by weight of a metal (aluminum) powder and having a surface layer of pure silicone resin. Station (7,8) on the work table serves as a location of the means for bending the footwear counter, and for stabilizing of the bend under pneumatic or hydraulic pressure at a refrigerated temperature.

Figure 2:
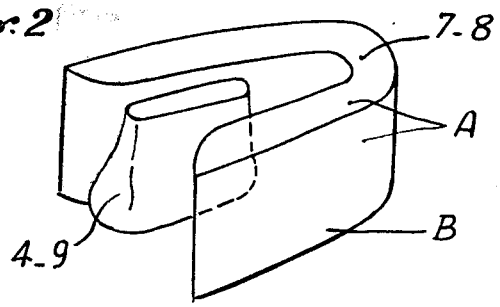
FIG. 2: a detail of a type of punch and a type of shaper especially adapted for use in the machine of FIG. 1.

In accordance with the showing in FIG. 2, the punches used (for example, 4, 5 or 9, 10) are very elongated and cover the exact shape of the counter. For example, they possess an average length of 150 mm for processing the counter of women's high-heel shoes. Moreover, the bending and stabilization shapers (7,8) are composed of a single piece of plastic (for example, a silicone resin or the like) but they exhibit two clearly different hardness numbers at a different portions thereof; for example, on the order of 50 to 70 shores hardness for upper part A of the shaper and in the range of 85 to 110 shores hardness for the base of the skirt or last edge B of the shaper.

In operation, the counters, which are cut flat from sheets of thermogluable synthetic material are introduced into the upper portion of the machine before being put into the reactivation position. The long cutters have not been prebented in a prior or preliminary operation. In the known second phase of the operation, which involves locking the counters in the shapers (7,8) having respective punches (9,10) while at a refrigerated temperature, excellent and clearly improved results are obtained in comparison with prior art bending devices because the very hard last edge (B) of the shaper assures perfect rigidity between the back elements of the footwear, while the more flexible upper part (A) of the shaper does not cause any creasing of the footwear during application of pressure on the footwear elements.

I claim:

1. Machine for bending long footwear counters comprising a first automatically operating double shaper/punch located on a frame at a first station, said shaper/punch being adapted for hot reactivation of the thermogluable material constituting the counter of the footwear, a second double shaper/punch located at a second station, for stabilizing the counter while at a refrigerated temperature, said machine being characterized in that it includes at two double stations a very long punch or last bent to the shape of the counter and further that the shaper, at said second station is formed from a single piece of plastic and exhibits in its last edge a hardness clearly greater than that exhibited at the upper part of the shaper.

2. Machine as in claim 1, wherein the upper part of the shaper exhibits a hardness of 50 to 70 shores, while the last edge exhibits a shore hardness number of 85 to 110.

3. Machine as in claim 2, wherein the stabilizing shaper is made of a single piece of thermoplastic silicone resin material.

* * * * *